US010647551B1

(12) United States Patent
Fournier et al.

(10) Patent No.: US 10,647,551 B1
(45) Date of Patent: May 12, 2020

(54) ROPE HOOK ASSEMBLY HAVING A LATCH MEMBER

(71) Applicant: Ulven Forging Incorporated, Hubbard, OR (US)

(72) Inventors: Steve Fournier, Cypress, TX (US); Michael John Secrist, Newberg, OR (US)

(73) Assignee: Ulven Forging Incorporated, Hubbard, OR (US)

( * ) Notice: Subject to any disclaimer, the term of this patent is extended or adjusted under 35 U.S.C. 154(b) by 16 days.

(21) Appl. No.: 16/171,137

(22) Filed: Oct. 25, 2018

(51) Int. Cl.
*B66C 1/36* (2006.01)

(52) U.S. Cl.
CPC ..... *B66C 1/36* (2013.01)

(58) Field of Classification Search
CPC ..... B66C 1/36; B66C 1/66; B66C 23/52
USPC ..... 294/82.2, 82.19, 82.23, 82.33; 24/599.5, 24/600.1
See application file for complete search history.

(56) References Cited

U.S. PATENT DOCUMENTS 1,324,676 A 12/1919 Knudsen
1,525,292 A * 2/1925 Greve ..... E21B 19/04 294/82.19
1,626,866 A * 5/1927 Neilson ..... E21B 19/04 294/82.2
3,575,458 A 4/1971 Crook, Jr. et al.
3,827,746 A * 8/1974 Byers ..... B66C 1/36 294/82.2
3,912,318 A 10/1975 Engh
4,039,220 A 8/1977 Stoops
4,977,647 A * 12/1990 Casebolt ..... B66C 1/36 24/599.5
5,480,202 A * 1/1996 Gloden ..... B66C 1/36 24/599.8
5,636,888 A * 6/1997 Kiser ..... B66C 1/36 294/82.19
5,832,572 A * 11/1998 Norrby ..... B60C 27/10 24/600.9
D503,328 S * 3/2005 Catlett ..... D8/342
9,561,939 B1 * 2/2017 Kusaka ..... B66C 1/36
9,630,809 B2 * 4/2017 Hoover ..... F16B 45/02

FOREIGN PATENT DOCUMENTS

EP 0007906 7/1982

* cited by examiner

*Primary Examiner* — Paul T Chin
(74) *Attorney, Agent, or Firm* — Klarquist Sparkman, LLP

(57) ABSTRACT

A hook assembly comprises a hook member and a latch member. The hook member has a body and a hook point defined at one end of the body. The hook point is spaced apart from and opposite a catch tab protruding from the body at an intermediate point on the body. A hook gap is defined between the hook point and the catch tab. The latch member is pivotably coupled to the body and movable between an open position in which the latch member is retracted toward the body and a closed position in which the latch member is pivoted to contact the hook point and thereby close the hook gap. The latch member defines a latch engagement opening sized larger than at least a portion of the catch tab so that the latch member is retractable past the catch tab in the closed position.

16 Claims, 5 Drawing Sheets

ROPE HOOK ASSEMBLY HAVING A LATCH MEMBER

BACKGROUND

A hook assembly, also referred to as a hook, is used to carry a load. Some types of hooks are designed to receive ropes, slings, straps or other flexible members that are in turn fastened to a load to be carried, such as by a crane or other lifting device.

Hooks are subject to movement during lifting and lowering operations, and they may make contact other objects causing a change in position that can lead to an inadvertent release of the rope or any other object carried by the hook.

Some hooks are carefully designed to have a geometry tending to prevent such inadvertent release. In some scenarios, it would be desirable to provide additional assurance against a rope or other object from becoming inadvertently released from a hook.

DETAILED DESCRIPTION

Described below are implementations of a rope hook assembly having a latch member designed to provide additional assurance against inadvertent release of a rope or other object carried by the hook.

Figure 1:
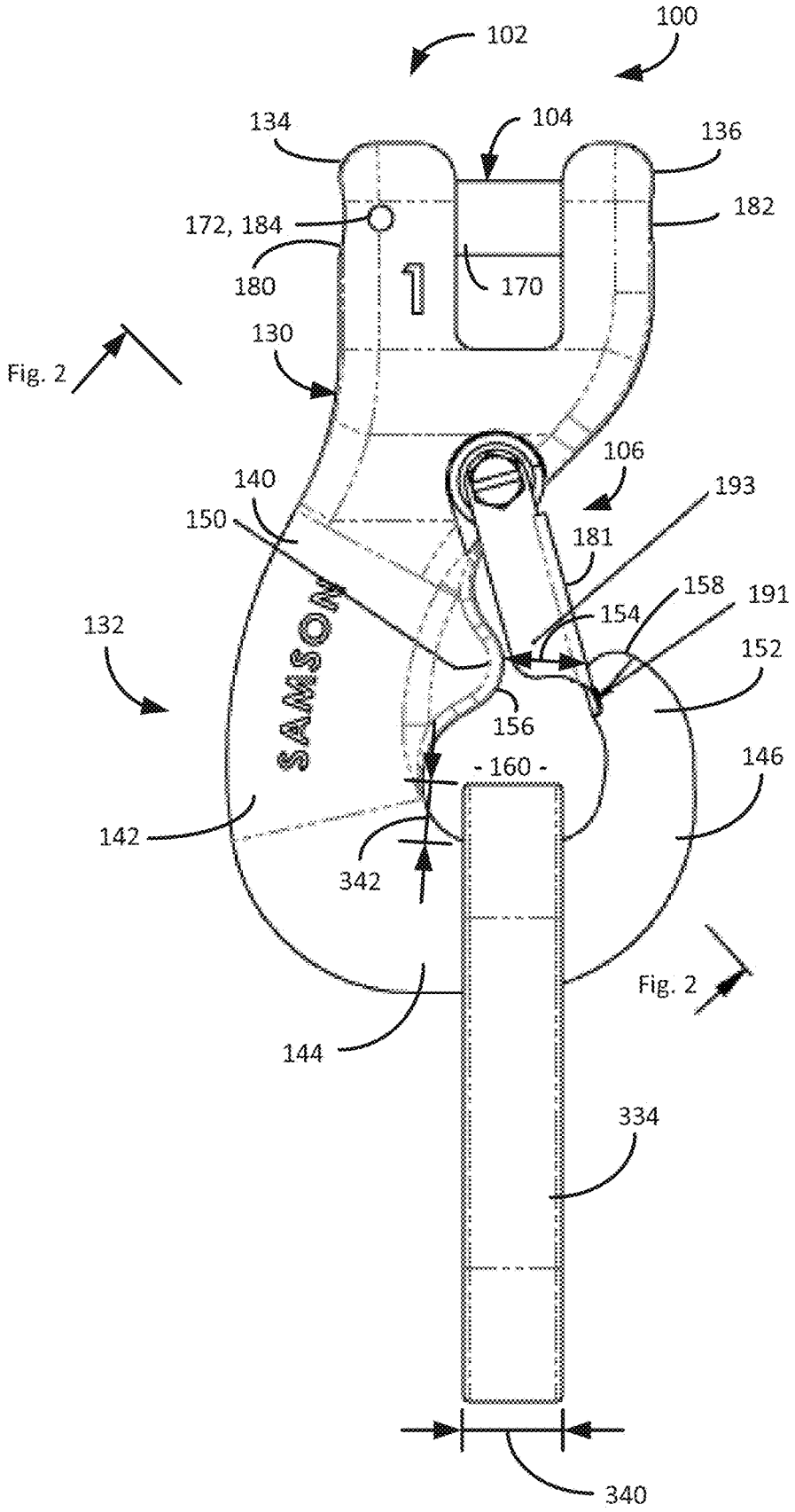
FIG. 1 is a front elevation view of an example rope hook assembly having a latch member.
Figure 2:
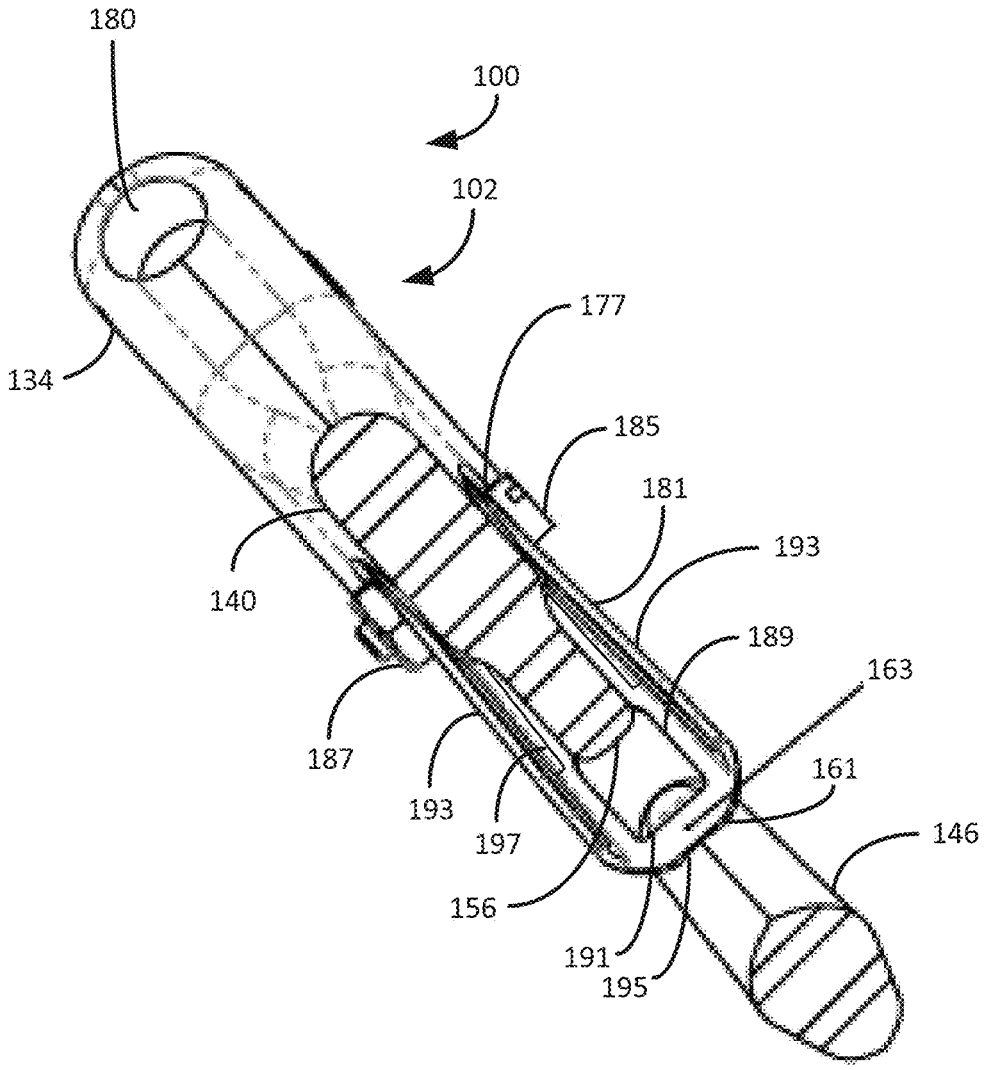
FIG. 2 is a section view of the hook assembly of FIG. 1 taken along the line 2-2 showing the latch member engaged with a point of the hook.
Figure 3:
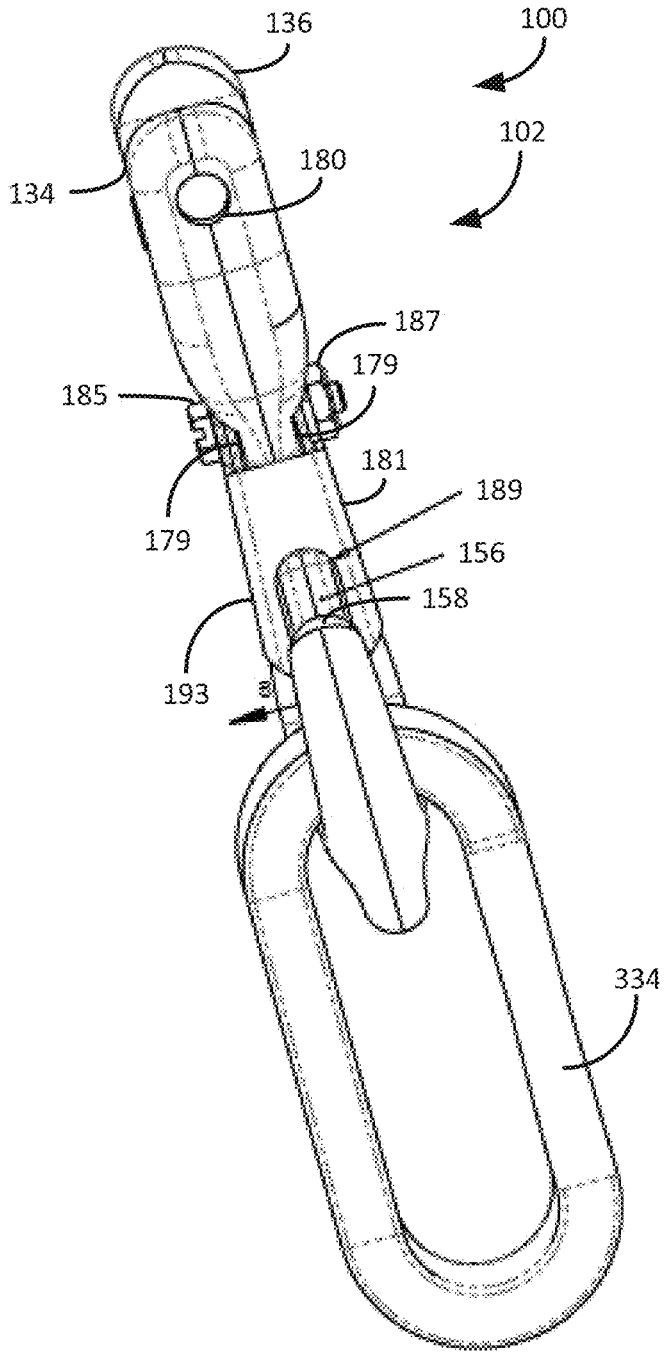
FIG. 3 is a side elevation view of the hook assembly of FIG. 1.

Referring to FIGS. 1-3, and example rope hook assembly 100 includes an example rope hook member 102 and an example pin assembly 104 (FIG. 1). The hook member 102 can have a solid body in which are defined a base portion 130, a hook portion 132, and first and second pin arms 134 and 136. The hook portion 132 defines a first hook portion 140, a second hook portion 142, a third hook portion 144, and a fourth hook portion 146. A first lock projection 150, also referred to herein as a catch tab, extends away from the main body in the area of the second hook portion 142. A second lock projection 152 in the area of the fourth hook portion 146 is at or near a distal end or tip of the hook member. A lock gap 154 is defined by the distance separating the first and second lock projections 150 and 152. The length of the example lock gap 154 is the shortest distance between a first point 156 on the first lock projection 150 and a second point 158 on the second lock projection 152. The lock gap 154 as shown in FIG. 1 is closed by a latch member 181 of the latch assembly 106, which is described below control in greater detail.

The hook member 122 further defines a hook main axis AH and a pin axis AP. The hook portion 132 generally extends from the base portion 130 in a first direction along the hook main axis AH, while the first and second pin arms 134 and 136 extend from the body portion 130 in a second direction along the hook main axis AH. The first hook portion 140 extends from the base portion 130 at an angle relative to the hook main axis AH. The second hook portion 142 extends at an angle from the first hook portion 140 along the hook main axis AH away from the body 130. The third hook portion 144 extends at an angle from the second hook portion 142 and crosses the hook main axis AH. The fourth hook portion 146 extends at an angle from the third hook portion 144 and back along the hook main axis AH toward the base portion 130. The first lock projection 150 is arranged on a first side of the hook main axis AH, while the second lock projection 152 is arranged on a second side of the hook main axis AH. The hook main axis AH thus extends through the lock gap 154 defined by the first and second hook projections 150 and 152 and through the latch member 181 closing the lock gap 154.

The hook portion 132 further defines a hook opening 160. The pin assembly 104 includes a pin 170 and a retainer 172. The first and second pin arms 134 and 136 define first and second pin arm openings 180 and 182, respectively. The first pin arm 134 further defines a retainer opening 184. In use, the pin 170 is inserted at least partly within the first and second pin arm openings 80, 82 such that the pin 170 extends between the first and second pin arms 134, 136. The retainer 172 extends through the retainer opening 184 and engages the pin 170 to inhibit removal of the pin 170 from the first pin arm opening 180 the pin assembly 104 thus engages the first and second pin arms 134 and 136 as is further described in greater detail below.

Figure 4:
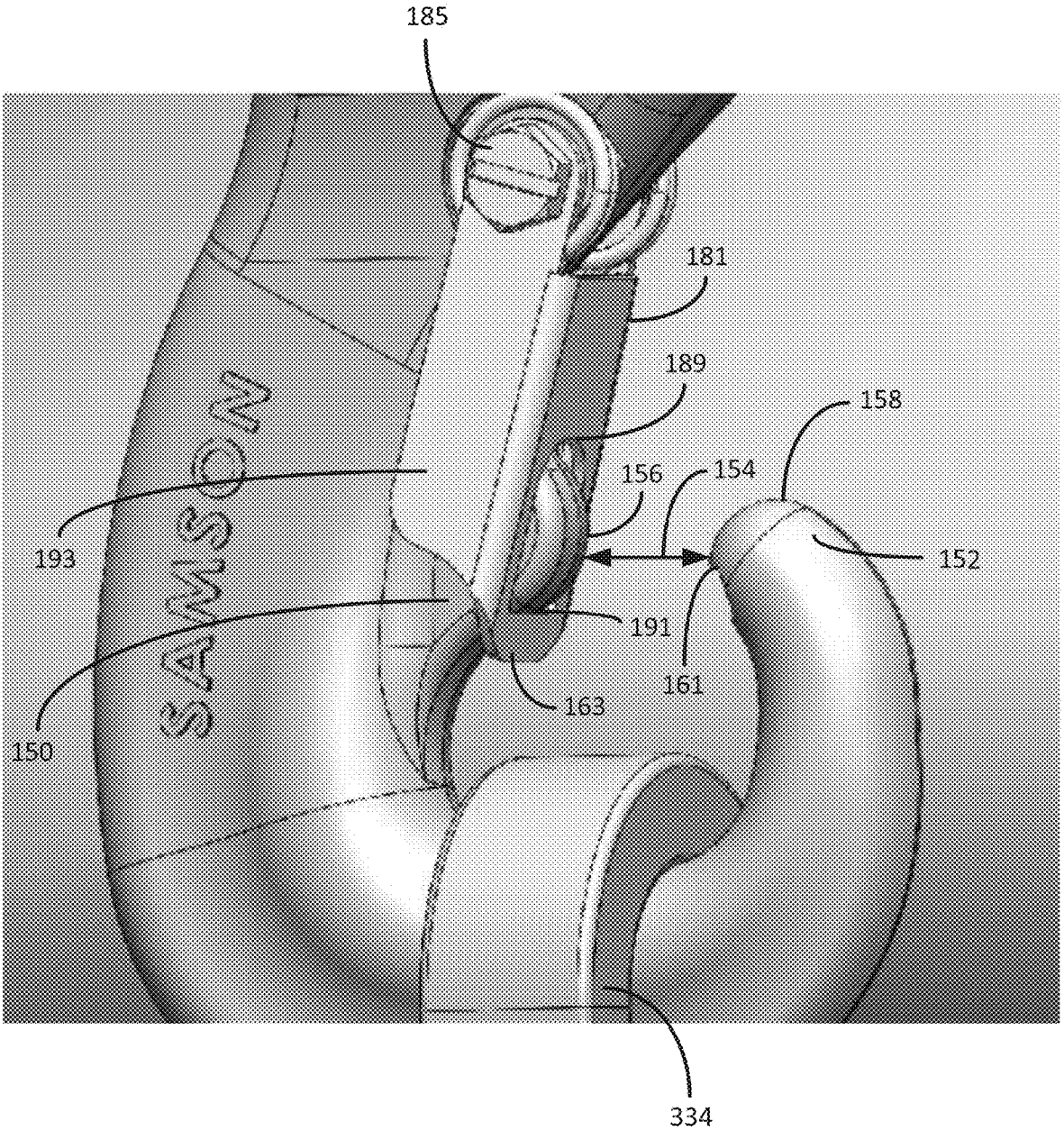
FIG. 4 is a perspective view of a portion of the rope hook assembly of FIG. 1, showing the latch member in an open position.

As shown in FIGS. 1, 3, and 4, the rope hook assembly 100 is shaped to receive and carry a rope segment 334 or other similar object received in the hook opening 160. In the illustrated implementation, the rope segment 334 as shown is in a slack condition and has a first dimension 340 and a second dimension 342. In general, passing the rope segment 334 through the lock gap 154 requires opposing or tension forces to be applied to the rope segment 334 such that it decreases slightly in size along its first dimension 340 so that it will fit between the first lock projection 150 and the second lock projection 152. In this way, the hook member 102 helps prevent inadvertent removal of the rope segment 334 from the hook opening 160 by having a lock gap 154 sized smaller than the corresponding dimension of the rope 334 carried by the hook member 102.

Figure 5:
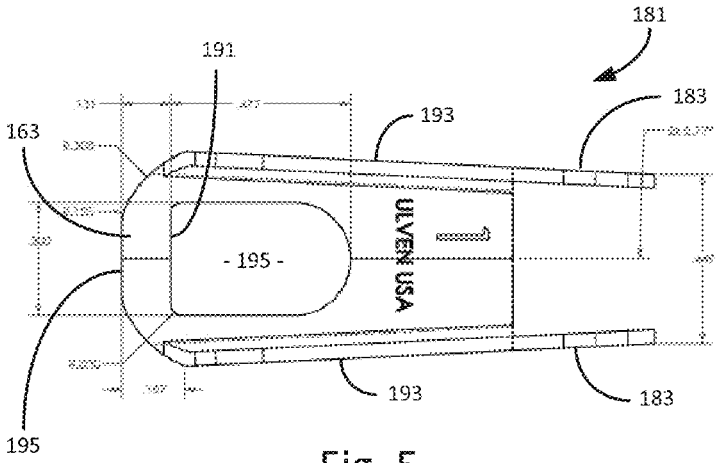
FIG. 5 is a bottom plan view of the latch member of FIG. 1.
Figure 6:
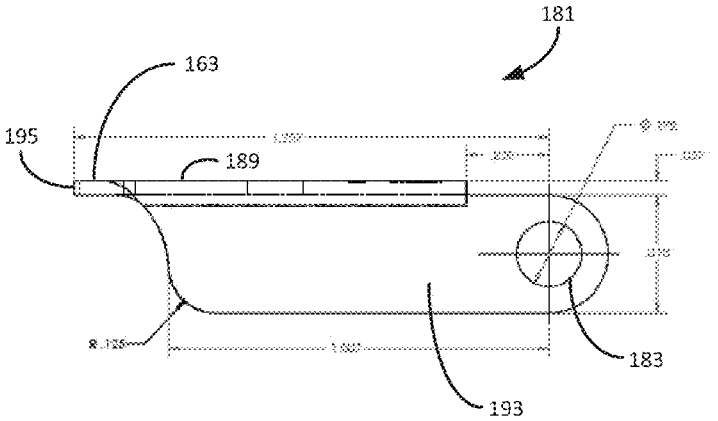
FIG. 6 is a side elevation view of the latch member of FIG. 1.

To provide greater assurance against inadvertent removal of the rope segment 334 from the hook opening 160, a latch assembly 106 can be provided. The latch assembly 160 is shown in FIGS. 1-4. The latch assembly 160 includes a latch member 181 (also shown in FIGS. 5 and 6), and a pivot member, such as a latch bolt 185 and latch nut 187 extending through a bore 177 (FIG. 2) in the hook member 102 to pivotably connect the latch member 181 to the hook member 102.

Referring to FIGS. 2-6, the latch member 181 has a main body portion in which a latch engagement opening 189 is defined. The latch engagement opening 189 can be spaced from a distal end 195 of the latch member 181 as shown. In this case, a distal edge of the engagement opening 189 is defined by a latch engagement edge 191, and a latch engagement tab 163 extends between the latch engagement edge 191 and the distal end 195. Along both sides of the latch member 181, there are opposing latch wing portions 193 extending toward the hook body on opposite sides thereof. The wing portions 193 have defined therein opposing latch bolt openings 183 dimensioned to receive a shaft of the latch bolt 185.

The hook member 102 can be provided with a latch member pivot region, e.g., a latch member recess 179 (FIG. 3) formed on each side adjacent the bore 177. The latch member pivot region or the latch member recess 179 is configured to allow the latch member 181 to pivot freely between the open and closed positions.

In FIGS. 1 and 2, the latch member 181 is in a closed position, i.e., the latch member 181 extends across and blocks the lock gap 154. In the illustrated implementation, the distal end 195 of the latch member 181 contacts the second lock projection 152 (hook point). Specifically, the second lock projection 152 can be formed with a latch tab recess 161 dimensioned to receive the latch tab 163. In the illustrated implementation, the latch tab 163 is received in the latch tab recess 161 with opposite edges of the latch tab 163 being in contact with or closely spaced from corresponding edges formed in the second lock projection 152 (hook point). In this way, the engagement between the latch member 181 and the second lock projection 152/latch tab recess 161 tends to prevent the latch member 181 from being dislodged in a lateral direction, such as by contact with another object.

In some implementations, the latch member 181 is biased towards the closed position, such as by a spring or a similar device. An example of a spring 197 is shown in FIG. 2. The spring 197 has a first leg portion, which is visible in FIG. 2 and extends along the latch member 181. The spring 197 can also have a coiled portion that encircles the latch bolt 185 and another leg portion positioned to contact a body of the hook, which are not visible in FIG. 2.

In FIGS. 3 and 4, the latch member 181 is shown pivoted to the open position in which the full dimension of the lock gap 154 is unobstructed by the latch member 181. As shown, the latch member engagement opening 189 is configured to allow the pass the latch member 181 to be move past the first hook point 156 with at least a portion of the first hook point 156 protruding through the latch member engagement opening 189. With the latch member 181 pivoted towards the open position as shown, the rope 334 can be intentionally removed from the hook member 102, if desired.

In view of the many possible embodiments to which the disclosed principles may be applied, it should be recognized that the illustrated embodiments are only preferred examples and should not be taken as limiting in scope. Rather, the scope of protection is defined by the following claims. We therefore claim all that comes within the scope and spirit of these claims.

We claim:

1. A hook assembly, comprising:

a hook member having a body and a hook point defined at one end of the body, the hook point being spaced apart from and opposite a catch tab protruding from the body at an intermediate point on the body, wherein a hook gap is defined between the hook point and the catch tab; and a latch member pivotably coupled to the body and movable between an open position in which the latch member is retracted toward the body and a closed position in which the latch member is pivoted to contact the hook point and thereby close the hook gap, wherein the latch member defines a latch engagement opening sized larger than at least a portion of the catch tab so that the latch member is retractable past the catch tab in the closed position.

2. The hook assembly of claim 1, wherein the latch member comprises a latch member body and the engagement aperture comprises a bounded opening defined in the latch member body.

3. The hook assembly of claim 2, wherein the latch member comprises a latch engagement edge configured to contact the hook point when the latch member is in the closed position.

4. The hook assembly of claim 2, wherein the latch member body comprises a generally planar main side facing the hook point.

5. The hook assembly of claim 4, wherein the latch member comprises a pair of spaced apart latch wings extending from opposite side edges of the main side and positioned to in a direction toward the catch tab and spaced from opposite sides of the body of the hook member.

6. The hook assembly of claim 5, wherein each of the latch wings comprises a respective pivot member opening.

7. The hook assembly of claim 1, wherein the latch member is spring-biased to the closed position.

8. The hook assembly of claim 1, wherein the latch member comprises a pivot connection to the hook member, and the wherein the pivot connection comprises a pivot member extending through aligned openings in the latch member and the body of the hook member.

9. The hook assembly of claim 8, wherein the pivot member comprises a bolt coupling the latch member to the body of the hook member.

10. The hook assembly of claim 1, wherein the body of the hook comprises a bore extending transversely through the body and latch member pivot regions defined on opposite sides of the body adjacent respective ends of the bore.

11. The hook assembly of claim 10, wherein the latch member pivot regions comprise recesses formed in the hook body.

12. The hook assembly of claim 1, further comprising an eye region defined at an end of the body opposite the hook point, wherein the eye region is configured for coupling the hook member to another object.

13. The hook assembly of claim 12, wherein the eye region comprises a first pin arm with a first pin opening and a second pin arm with a second pin opening, further comprising a pin shaped to fit through the first and second pin arms.

14. The hook assembly of claim 1, wherein the hook point comprises a latch engaging surface, and wherein the latch member engages the latch engaging surface when the latch member is in the closed position.

15. The hook assembly of claim 14, wherein the latch engaging surface comprises a planar surface formed on a side of the hook point facing the catch tab.

16. The hook assembly of claim 1, wherein the body of the hook member has a curving inner surface extending from the hook point to the catch tab and defining a hook opening having a dimension greater than the hook gap.

* * * * *